United States Patent [19]

Rhodes

[11] Patent Number: 5,026,063

[45] Date of Patent: Jun. 25, 1991

[54] GOLF SWING TRAINING CLUB

[76] Inventor: Stephen B. Rhodes, 412 West 2nd St., Roswell, N. Mex. 88201

[21] Appl. No.: 564,286

[22] Filed: Aug. 8, 1990

[51] Int. Cl.[5] ..... A63B 69/36

[52] U.S. Cl. ..... 273/186 A; 273/193 A; 273/80 B

[58] Field of Search ..... 273/186 R, 186 A, 186 C, 273/193 R, 193 A, 193 B, 194 R, 194 A, 80 B, 183 B

[56] References Cited

U.S. PATENT DOCUMENTS 3,317,211 5/1967 Debski ..... 273/193 B X 4,118,033 10/1978 Miyamoto ..... 273/193 R X

*Primary Examiner*—George J. Marlo

*Attorney, Agent, or Firm*—Hoffman, Wasson & Gitler

[57] ABSTRACT

A golf training club includes a shaft having a weighted, cylindrical head at one end, and a handgrip at the other end. The shaft consists of a single piece of tubular plastic material of uniform cross-section and uniform composition.

7 Claims, 2 Drawing Sheets

GOLF SWING TRAINING CLUB

BACKGROUND OF THE INVENTION

This invention relates generally to the field of sporting equipment, and particularly to a training golf club which is designed for improving or practicing the swing, without actually striking a ball.

Golf swing teaching theory that stresses feeling the swinging motion of the head of a regular club has a long history. This theory has had such notable proponents as Ernest Jones, Dave Marr, and Manuel de la Torre. It teaches players to learn the proper motion of the swing in a natural, sensory way. This approach to learning the correct swing overcomes tendencies of most golfers to focus too strongly on purely mechanical aspects of the swing (such as keeping the left arm straight, or the head down). The importance of feel is illustrated by the fact that Ben Doyle, a well known and respected golf teaching professional, has even had students swing a mop to get them to feel the lagging action of dragging the clubhead, rather than throwing it. (See Golf Digest, August 1983, pages 81–83).

I have found that one can better learn the feel of a proper swing by using a warm-up or practice club having a very flexible shaft, and a head that is heavier than that of a standard driver, and have embodied these features in the practice club described below.

There are currently a number of weighted swing trainers on the market, but none with a particularly flexible shaft. Two known training clubs are the Swinger, from Golfsmith, and Assist by Matzie. The latter has an angular shaft, and may be covered by U.S. Pat. No. 4,511,147. There is also a warm-up weight donut for golf clubs, and a weighted head cover, for a standard driver.

A practice club having a particularly flexible shaft has been previously described, in U.S. Pat. No. 4,118,033. The club described therein is similar in appearance to my club, in that it has a cylindrical, weighted head at one end of a flexible shaft, the other end of which has a handgrip. The shaft of the prior club includes a composite core member which is inflexible at the end adjacent the grip, and flexible at the other; the composite member is surrounded by steel wires which give the shaft a weight in the 750–850 gram range. A separate covering layer is provided over the wires. This complex construction may generate production costs that could be avoided, and places substantial weight in the shaft.

SUMMARY OF THE INVENTION

In view of the foregoing, it is an object of this invention to produce a warm-up club having a very flexible, shaft and a heavy head, of simple construction. A related object is to reduce production costs for a warm-up or training club of this type. A further object is to minimize the weight of the shaft of a training club.

I have found that a perfectly suitable club for achieving the above objects can be made with a shaft formed from standard stock extruded tubular plastic material, without reinforcement of any kind.

The invention is embodied in a warm-up club having a flexible shaft formed from a length of plastic tubing having a constant cross-section and uniform composition, with a weighted head mounted at one end of the shaft, and a grip at the other end of the shaft.

This club is designed to assist any golfer to learn the correct fluid motion of a powerful, well-executed full swing, and also works to correct common swinging faults. It gives the beginner an easy way to learn the true feeling and correct motion of a good golf swing, and also strengthens the muscles used for golf. Finally, it is ideal to use during warm-up, since it tones and stretches the golfing muscles as it helps the golfer regain the feel of a proper swing, which is necessary to play good golf.

This club combines two features that have previously been used separately in swinging aids: a club with extra weight in the head, and an extra flexible shaft. These features, combined, do more to promote a smooth swing than either used separately.

Since this practice club does not have a face for striking a ball, it is not officially counted as a club, and can be carried in addition to the standard complement of clubs.

BRIEF DESCRIPTION OF THE DRAWINGS

In the accompanying drawings.

DESCRIPTION OF THE PREFERRED EMBODIMENT

Figure 1:
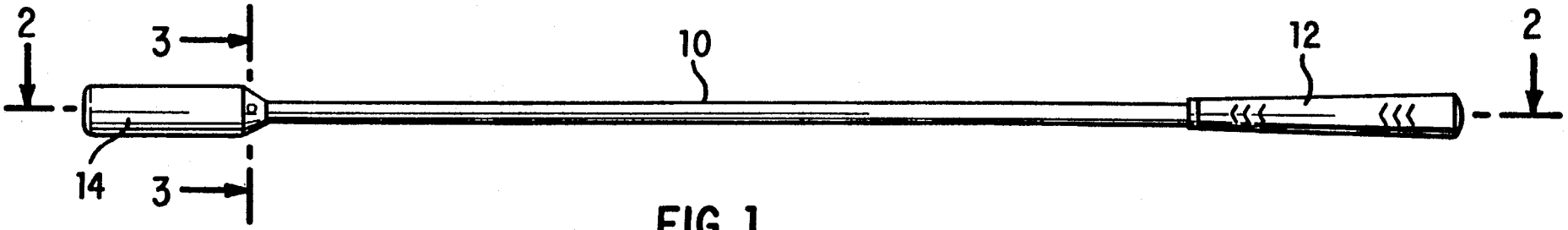
FIG. 1 is a side elevation of a warm-up club embodying the invention.
Figure 3:
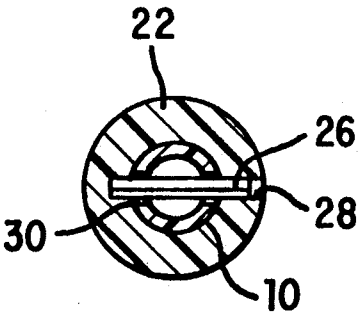
FIG. 3 is a sectional view, at a further enlarged scale, taken along the line 3—3 in FIG. 1.
Figure 2:
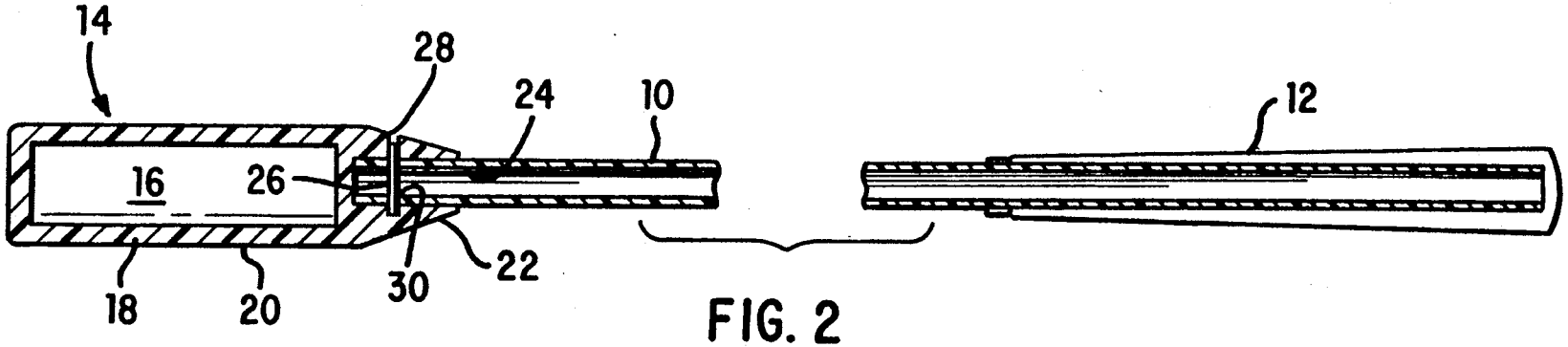
FIG. 2 is a sectional view, at an enlarged scale, taken along the line 2—2 in FIG. 1.

Referring to FIGS. 1–3, the invention is embodied in a warm-up club for golf, comprising a shaft 10 preferably made from inexpensive extruded polyvinylchloride (PVC) material. A suitable such material is available from plumbing supply houses, and is designated as "C-PVC" pipe, which is designed for carrying hot water. The presently preferred "half-inch" tubing has an outside diameter of five-eighths inch and an inside diameter of one-half inch, with a one-sixteen inch wall thickness. Tubing with these dimensions produces the desired degree of flex when used in a club having an overall length of about 43½ inches. The resulting flexibility would be graded "AAAA" by standard club flexibility tests (considerably more flexible than the "A" grading for senior citizens' clubs).

C-PVC pipe is extruded from polyvinylchloride, and therefore has uniform cross-sectional shape and composition, and consequently uniform bending stiffness. This is in contrast to standard golf clubs, which have tapering shafts to provide greater flexibility near the head than near the grip. I have found that, whereas a tapered construction may be necessary to produce proper ball flight in a regular club, taper is unnecessary to produce proper feel, and thus simple stock material can be used for the shaft of a training club.

A standard grip 12 is adhered to the upper end of the shaft, in a standard manner. A suitable grip is known as the "Alpha Grip", manufactured by Golfsmith of Austin, Tex., Stock No. 147.

The head 14 of the club comprises a solid, cylindrical metal core 16, surrounded by a covering 18 of either reinforced fiberglass, or injection molded plastic. If fiberglass is used to cover the core, the core may be made of lead; however, steel is preferred within injection molded coverings, because of its higher melting temperature. The preferred weight of the head is about fifteen ounces.

The head has a cylindrical outer surface 20, with a tapered upper end 22 forming a frustoconical surface. The shaft extends into a bore 24 concentric with the frustoconical surface, where it is attached to the head by means of an expansion pin 26 that extends into a blind hole 28 in the tapered portion of the head, and through aligned, diametrically opposed holes 30 in the shaft 10.

In use, one may practice individual, complete swings, at a slightly slower speed than normal because of the extra head weight. One can also practice a continuous pendulum swing, forward and backward, allowing the weight of the head to carry the club. The whole body should be felt to swing the club, around the relatively fixed axis of the top vertebrae. One should feel a smooth transition between the forward swing and backswing, and the natural acceleration of the club head through the impact zone.

Figure 4:
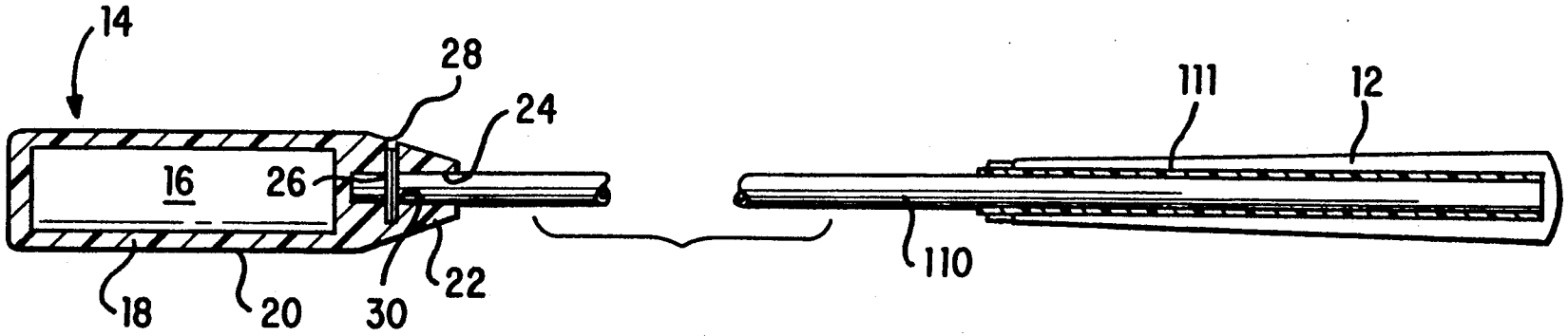
FIG. 4 is a view corresponding to FIG. 2, showing a first modification of the invention.

The flexibility of the shaft is affected by its length, inside diameter, outside diameter, and its modulus of elasticity (which is a function of the composition of the shaft). One could appropriately vary these factors in concert without deviating from a desirable flexibility. For example, one could reduce both the inside and outside diameters of the shaft, even to the point of producing a solid shaft 110, as shown in the variation of FIG. 4. If a small diameter shaft is used, it may be necessary to place a concentric spacer 111 around the shaft, in the vicinity of the grip.

Figure 5:
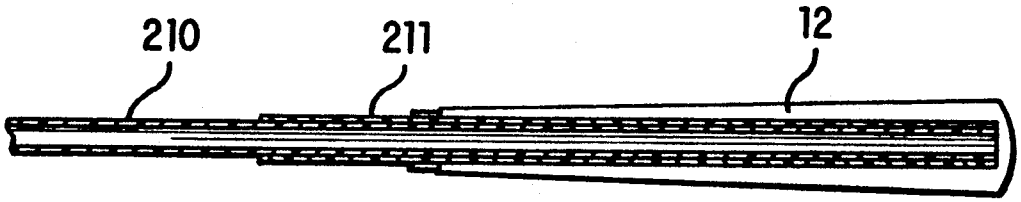
FIG. 5 is a view corresponding to a portion of FIG. 4, showing a second modification of the invention.

A second variation of the invention is shown in FIG. 5, wherein a concentric PVC tube 211 is placed between the shaft 210 and the grip, and extending about four inches beyond the grip. One consequence of this construction would be to stiffen the shaft in the vicinity of the grip.

Inasmuch as the invention is subject to other modifications and variations, it is intended that the foregoing description and the accompanying drawings shall be interpreted as illustrative of only one form of the invention, whose scope is to be measured by the following claims.

I claim:

1. In a golf training club comprising a shaft having a weighted, cylindrical head at one end, and a handgrip at the other end, the improvement wherein that portion of the shaft between the handgrip and the head consists of only a single piece of tubular plastic material of uniform cross-section and uniform composition and provides an extra flexible shaft in a club capable of being used to correct in a proper club swing motion and strengthen the muscles used in swinging a golf club.

2. The invention of claim 1, wherein said plastic material consists essentially of polyvinylchloride.

3. The invention of claim 2, wherein said polyvinylchloride material is extruded.

4. The invention of claim 3, wherein said extruded material is half-inch inside diameter "C-PVC" standard plumbing pipe.

5. The invention of claim 1, wherein said head comprises a cylindrical core of solid metal, surrounded by a covering of fiberglass material.

6. The invention of claim 1, wherein said head comprises a cylindrical core of solid metal, surrounded by a covering of extruded plastic material.

7. The invention of claim 1, wherein the weight of said head is at least fifteen ounces avoirdupois.

* * * * *